United States Patent [19]

Mullins, II

[11] 4,311,195

[45] Jan. 19, 1982

[54] HYDRAULICALLY SET WELL PACKER

[75] Inventor: Albert A. Mullins, II, Humble, Tex.

[73] Assignee: Baker International Corporation, Orange, Calif.

[21] Appl. No.: 168,961

[22] Filed: Jul. 14, 1980

[51] Int. Cl.[3] ..... E21B 33/128

[52] U.S. Cl. ..... 166/120; 166/182

[58] Field of Search ..... 166/120, 212, 182

[56] References Cited

U.S. PATENT DOCUMENTS

| | | | |
|---|---|---|---|
| 3,112,796 | 12/1963 | Myers | 166/212 |
| 3,142,338 | 7/1964 | Brown | 166/120 |
| 3,282,342 | 11/1966 | Mott | 166/120 |
| 4,216,827 | 8/1980 | Crowe | 166/120 |
| 4,263,968 | 4/1981 | Garner, Jr. | 166/120 |
| 4,285,400 | 8/1981 | Mullins | 166/120 |

*Primary Examiner*—James A. Leppink

*Attorney, Agent, or Firm*—William C. Norvell, Jr.

[57] ABSTRACT

A double grip well bore packer which is run into a well casing on a tubular conduit string has actuator means responsive to applied fluid pressure to set slips and to force a packing into engagement with the casing, and the setting force is locked into the packing. The applied setting force results from relative axial movement between an inner body mandrel, a setting mandrel and a housing surrounding the lower end of the inner body mandrel to define a pressure chamber housing a releasing piston. A bottom member defines the lower end of the housing and provides a mounting for a removable plug which closes the tubing bore to permit build-up of tubing pressure to set the packer, including limited pressure induced upward movement of the inner mandrel body relative to the bottom member to facilitate the application of the setting forces.

12 Claims, 10 Drawing Figures

HYDRAULICALLY SET WELL PACKER

BACKGROUND OF THE INVENTION

1. Field of the Invention

The invention relates to packers of the type adapted to be set and anchored in a well bored casing by fluid pressure, to form a seal between a tubing string and the casing without longitudinal or rotational manipulation of the tubing string.

2. DESCRIPTION OF THE PRIOR ART

Fluid pressure set well packers are well known, including, as examples, those shown and described in U.S. Pat. Nos. 3,112,796 to Myers, 3,131,769 to DeRochemont, and that disclosed in U.S. application Ser. No. 907,121, filed May 18, 1978, now U.S. Pat. No. 4,216,827 entitled "Fluid Pressure Set And Released Well Packer Apparatus," in the name of Talmadge L. Crowe, which is assigned to the assignee of the present invention.

Under some circumstances, such packers may not be conveniently set within the well, primarily for the reason that the inner mandrel or body of the packer may extend entirely through the packer from top to bottom. Hence, in order to set such a packer, it may be necessary to blank the tubing below the packer which might result in a hydraulic load being imposed on the packer inner mandrel body which might prevent upward shifting of such body during the setting of the packer. Such action, in turn, may prevent all of the available setting force from being applied to the expandable elements of the packer.

SUMMARY OF THE INVENTION

This invention provides an improved fluid pressure actuated packer of the type employing a tubular inner mandrel connectible in a tubing string and having slips and resilient packing means normally retracted to allow running of the packer, on the tubing string. Setting means for expanding the slips and the packing means include an outer mandrel and housing structure on the tubular inner mandrel and defining therebetween an atmospheric chamber and an operating pressure chamber. Releasable means are provided to hold the mandrels and the housing against relative longitudinal movement until the releasable means is pressurized through the tubing to cause release.

The tubing pressure is applied to a blanking valve or plug which is mounted at the lower end of the outer housing, below the inner mandrel, thereby permitting relative upward movement of the inner mandrel with respect to the outer mandrel during the tubing pressurization. Upon release of the releasable means, hydrostatic pressure acts on the outer mandrel structure to shift it downwardly relative to the housing and the inner mandrel to set the slips and to deform the packing outwardly into sealing engagement with the casing. A ratcheting lock permits relative movement of the mandrels to set the packer and locks the setting force into the resilient packing between the mandrels and the housing. The inner mandrel and the housing also define therebetween a releasing piston chamber, in which a release piston is pressure balanced in a position limiting relative axial displacement of the housing and inner mandrel.

Upon landing a release tool in the inner packer mandrel and operating the release tool to bleed the released piston chamber at one side of the release piston to an atmospheric chamber in the release tool, the applied tubing pressure shifts the release piston to cause release of the inner mandrel and the housing, enabling relaxation of the packing and retraction of the slips.

DESCRIPTION OF THE PREFERRED EMBODIMENTS

Figure 1A:
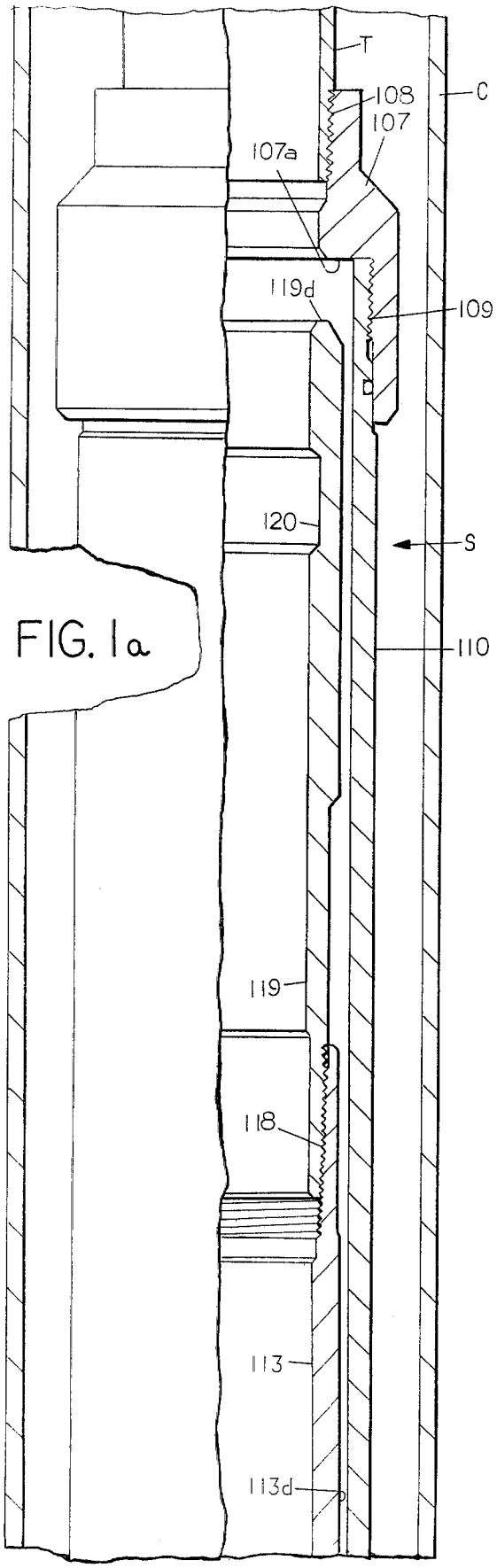
FIGS. 1*a*–1*d* together constitute a vertical elevational view, partly in section, of a packer and an on-off sealing connector with the components thereof in the positions occupied during the running in of the packer into the well casing.

Referring first to FIGS. 1*a* through 1*d*, a double grip, pressure set and pressure released packer P is connected by an on-off sealing connector S in a running string of pipe or tubing T, by which the packer P is adapted to be lowered from the top of the well to the selected location in a well casing C. The packer P may be the only packer in the tubing string T or it may be incorporated in a plural packer set-up, that is, the lower packer in a multiple string packer hook-up or in a plural packer single tubing string. The packer P is adaptable to such a variety of installations inasmuch as it is pressure set and normally pressure released without requiring tubing string manipulation.

An elongated inner mandrel body 10 extends through the packer and has an upper threaded end 11 engaged in the lower end 117 of the on-off sealing connector S. At its lower threaded end 13, the mandrel body 10 is threadably connected to an isolation sleeve 14.

Disposed about the inner mandrel body 10 is an outer mandrel structure 15, including a lower, connector mandrel section 16 and an upper, packing mandrel section 17 joined together at a threaded joint 18, below which is a downwardly facing internal shoulder 16*a*. At its upper end, the packing mandrel 17 is threadably engaged at 20 in a head 21 of hold-down means or "buttons" 22, below which is resiliently deformable packing means 23 adapted to be axially and circumferentially deformed outwardly into sealing engagement in the casing C, between the hold-down head 21 and lower anchor slip means 24, when the packer P is set.

Below the slip means 24, and co-axially disposed about the connector mandrel section 16 and the lower portions of inner mandrel body 10, is a tubular housing 25 which is threadably connected at its lower end 26 to a radially enlarged top portion of a bottom sub member 5. The lower portion of the bottom sub 5 is threaded at 5*a* for connection to an additional length of tubing, or to a bottom anchor or the like. The bottom sub 5 defines an upwardly facing shoulder 5*b* which is engaged with the bottom of an isolation sleeve 14 in the pre-set or running-in position. The top end of the housing 25 is threadably secured, as at 58, to the lower threaded end of a slip ring or camming sleeve 57, thus axially anchoring such slip ring.

In the annular space defined between the tubular housing 25 and the exterior surface of the isolation sleeve 14, an annular releasing or shearing piston 28 is slidably mounted. O-ring seal means 28*a* and 28*b* are respectively provided on the outer and inner surfaces of the annular releasing piston 28. A radial passage 14*a* is provided in the isolation sleeve 14 at a point adjacent the lower end of the releasing piston 28 to provide tubing bore pressure to the bottom end of piston 28.

The piston 28 is secured in an axially fixed position relative to inner mandrel body 10 by an annular releasing cap 29 which is internally threaded to engage external threads 28*c* on the top, reduced diameter end of the releasing piston 28. The cap 29 has an internally projecting top flange portion 29*a* overlying the top end of the reduced diameter threaded portion 28*c* of the releasing or shear piston 28, and this flange portion 29*a*, in turn, abuts the lower end surface 13*a* of the inner body mandrel 10. Movement of the releasing piston 28 relative to body mandrel 10 is prevented by the engagement of the lower surface of the flange 29*a* with an annular shear ring 30 which has a shearable flange portion 30*a* embedded in an annular slot 14*b* provided on the adjacent surface of the isolation sleeve 14.

An annular space 98 is provided around the exterior of the cap 29 of the releasing piston 28, and this annular space is in fluid communication with tubing pressure through a radial port 14*c* provided in the isolation sleeve 14, an annular recess 28*d* and one or more radial ports 28*f* provided in the medial portions of the releasing piston 28. Thus, in the positions of the elements illustrated in FIGS. 1*a* through 1*d*, the pressure existing in the tubing bore is transmitted to both sides of the releasing piston 28 and the pressure forces on the releasing piston 28 are essentially balanced, so that the piston 28 remains in the illustrated position relative to the isolation sleeve 14 and the housing 25. It should be further noted that the shear ring 30 effectively limits upward movement of the mandrel 10 relative to the housing 25 to the vertical spacing provided between the releasing piston 28 and an isolation piston 27 mounted in the chamber 98 above the releasing piston 28 and abutting a downwardly facing shoulder 25*a* on the housing 25. Seals 27*a* and 27*b* are provided on the annular isolation piston 27 which cooperate with the outer surface of the inner mandrel body 10 and the inner surface of the housing 25, respectively.

Figure 1B:
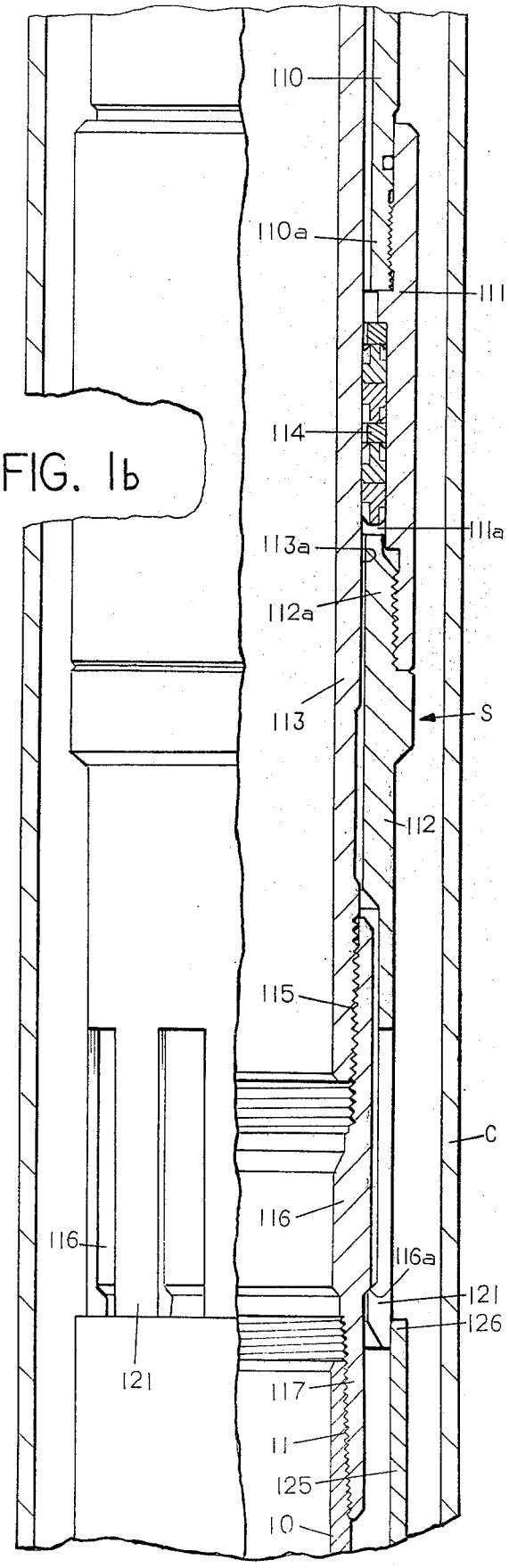
Figure 1C:
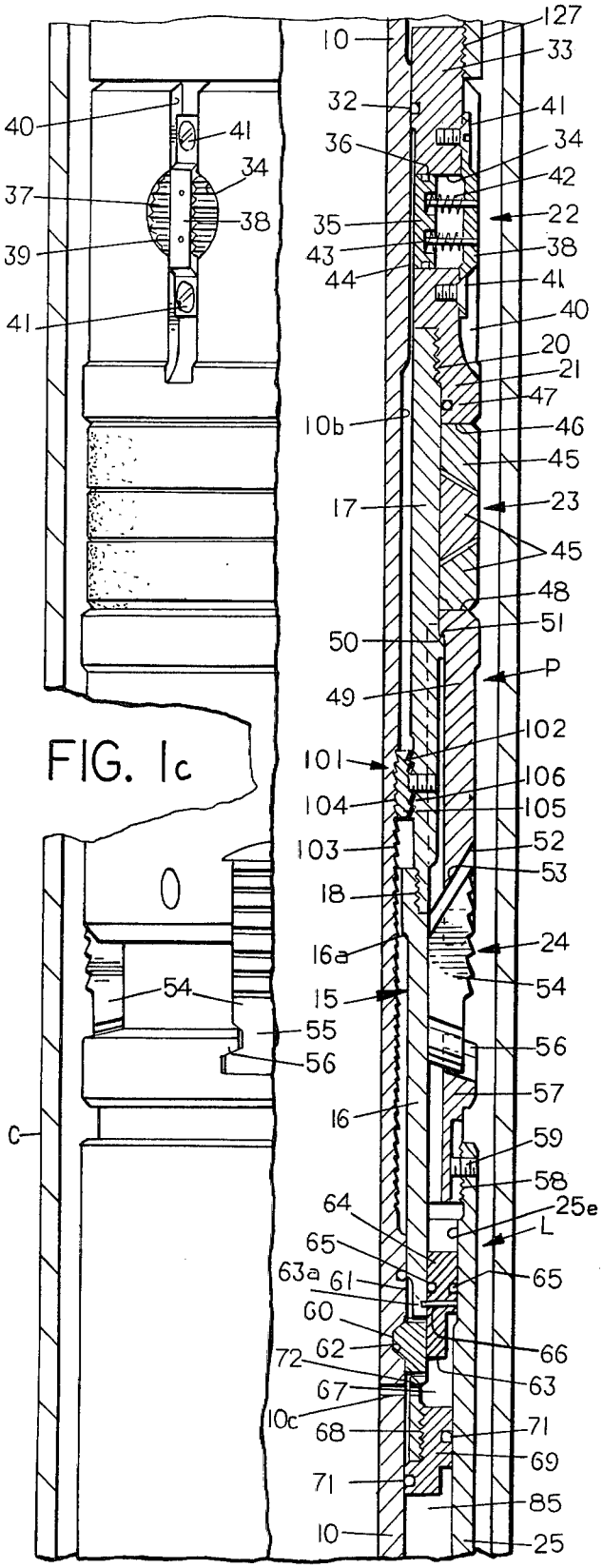

The upper hold-down head 21 cannot move downwardly on the mandrel body 10 in the well insertion position, illustrated in FIGS. 1*a* through 1*d*, since the outer mandrel structure 15 is releasably connected to the inner mandrel or body 10 by releasable latch means L (FIG. 1*c*). The packer assembly is therefore maintained in a stretched out condition during running into the well.

The hold-down means 22 is of the fluid pressure operated type, preferably as more particularly disclosed in the above identified U.S. Pat. No. 3,131,769. As shown, the hold-down means 22 has an internal seal ring 32 between the mandrel body 10 and the upper end 33 of the head 21. A plurality of radial bores 34 in the head 21 below the seal 32 have pistons or anchor buttons 35 reciprocable in the bores 34, and having side or piston rings 36 sealingly engaged therebetween. These pistons or buttons 35 have teeth or wickers 37 on their outer ends engageable with the casing C upon outward movement of the buttons, to anchor the packer P against upward movement in the bore hole after the packer P is set and in the presence of differential fluid pressure from below the packer P.

Each anchor button 35 is appropriately oriented with its wickers or teeth 37 disposed normal to the axis of the cylinder 34 by an orienting and retaining bar 38 extending through a longitudinal slot 39 in each button anchor element opening through its exterior, the retainer bar 38 also extending into upper and lower grooves 40 in the body 21 on opposite sides of the anchor element. The piston retainer bar 38 is suitably secured to the body 21 by screws 41 and supports one or a plurality of biasing means 42, which may be helical compression springs, mounted in the longitudinal slot 39, the outer ends of which engage the retainer bar 38, and the inner ends of which are disposed in sockets 43 in the anchor element in engagement with an inner face of the latter. As disclosed in the drawings, two longitudinally spaced springs 42 are mounted in each piston anchor or gripping element 35.

The springs 42 urge the anchor elements toward their retracted position. When sufficient pressure is developed in the annular space 44 between the body 10 and the head 21 to overcome the force of the springs 42, the anchor elements 35 are urged outwardly to engage their teeth with the wall of the well casing C. When such pressure is relieved, the springs 42 return the anchor elements 35 to their fully retracted position.

The packing means 23 comprises a plurality of resiliently deformable, elastomeric rings 45, having tapered abutting surfaces, disposed about the packing mandrel 17 between the lower end shoulder 46 of a skirt 47 of the hold-down head 21 and an upwardly facing shoulder 48 of a tubular expander body 49 forming part of the anchor means 24. This expander body 49 has an internal shoulder 50 facing downwardly and seating on an upwardly facing outer shoulder 51 on the mandrel section 17. At its lower end, the expander member 49 has a downwardly and inwardly inclined expander or cone surface 52 cooperative with opposed downwardly and inwardly inclined end surfaces 53 of the anchor slip elements 54. These slips elements 54 have a dove-tailed, sliding connection 55 with the conical and oppositely inclined T-head connections 56 on the upper end of a slip ring or camming sleeve 57 which, as previously mentioned, is threaded at 58 into the upper end of the lower housing 25. A lock screw 59 secures the threaded connection 58.

As previously indicated, the outer mandrel structure 15 is held in an upper position during running, with the anchor slip means retracted, by the releasable latch means L shown in FIG. 1*c*. This latch means includes a latch element or elements in the form of circumferentially spaced, annular segments 60 bridging between the inner mandrel 10 and the connector mandrel section 16 by mounting in radial openings 61 provided in the mandrel section 16. The segments 60 engage in an annular groove 62 provided in the outer surface of the inner mandrel body 10.

The segments 60 are retained in the latching position of FIG. 1*c* by a reduced thickness skirt portion 63 of an annular segment retainer 64 which is disposed between the inner cylindrical wall 25*e* of the housing 25 and the outer cylindrical wall of the connector mandrel 16. Suitable side ring seals 65 are provided on the opposed walls of segment retainer 64 to cause it to function as a piston, such side ring seals being engaged with the opposed cylindrical walls of the housing 25 and connector mandrel 16. A plurality of shear screws 66 are threaded through the segment retainer piston skirt 63 at a selected number of circumferentially spaced locations and extend into a slot 63*a* in the connector mandrel 16 to releasably retain the segment retainer piston 64 in the position of FIG. 1*c* and thereby releasably hold the outer mandrel structure against relative movement on the inner body mandrel 10, since the latching segments 60 are held in the annular groove 62.

Below the segment retainer piston 64 is an annular piston chamber 67 defined between the opposed inner cylindrical wall 25*e* of the housing 25 and the outer cylindrical walls of the mandrel body 10. An annular piston 69 is mounted on the lower end of the connector mandrel 16 by threads 68. The annular piston 69 has inner and outer side ring seals 71 slidably engaging the aforementioned mandrel body and housing cylindrical surfaces. Fluid is admissible to the annular chamber 67 between the pistons 64 and 69, through a suitable number of radial ports 10*c* in the mandrel body 10 which communicate between the bore thereof and the piston chamber 67, and also communicate with radial ports 72 provided in the connector mandrel 16.

Thus, it is now apparent that the latch means L can be released by applying, through the tubing T and the mandrel body 10, sufficient fluid pressure to cause an upward force on the latch retaining piston 64 which will shear screws 66 and, move the retaining piston 64 upwardly and allow the segments 60 to move outwardly from their seat 62. In order to accomplish the increase in pressure in the tubing T, conventional means (not shown) for temporarily blanking either the bottom sub 5 or the tubing below the bottom sub 5 is provided, such as a wireline set and manipulated blanking plug.

Below the upper piston 69, between the housing 25 and the inner body or mandrel 10 (FIGS. 1*c* and 1*d*) is an annular atmospheric or low pressure chamber 85 defined between the upper piston 69 and the lower isolation piston 27. Pressure in chamber 85 is determined by the initial assembly of the packer P, hence is usually atmospheric. The isolation piston 27 has a lower annular extension 27*c* which can move downwardly to contact the shoulder 28*e* on the releasing piston 28, which, however, is retained against downward movement by the shear sleeve 30.

Figure 1D:
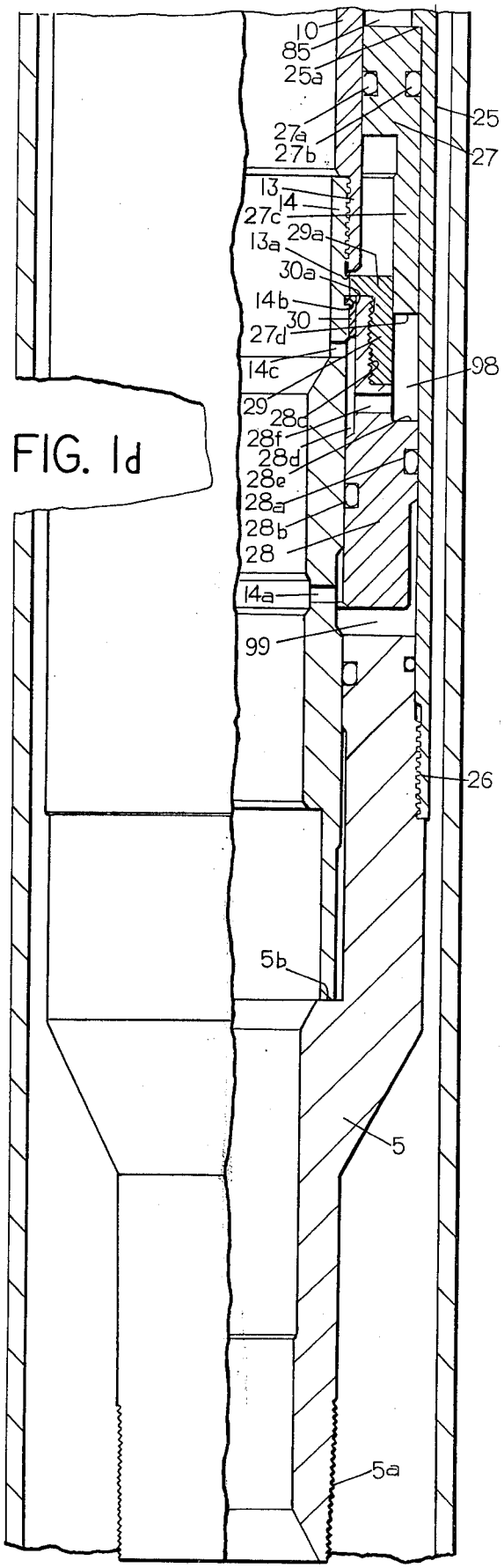

Under the conditions shown in FIG. 1*d*, the annular piston 28 has equal end areas exposed to tubing fluid pressure in the upper and lower annular spaces 98 and 99, is pressure balanced, and exerts no shearing force on the shear ring 30. Accordingly, when the tubing pressure is increased to shear screws 66, the retainer piston 64 moves upwardly to release the latch segments 60. This permits the outer mandrel structure 15 to be forced downwardly by the pressure differential across the upper piston 69. Concurrently, the inner body mandrel 10 is moved upwardly by the larger differential area thereof below the seal 32 in the head 21 being exposed to the increased tubing pressure, until the isolation piston 27 and the release piston 28 are brought into abutment. Thus, the packer P may be set to the position illustrated in FIGS. 2*a*, 2*b* and 2*c*.

Means are provided which are operable when the packer is set to lock the pack-off force into the resilient packing elements 45. Such means generally designated 101 (FIGS. 1*c* and 2*b*) comprises one way ratchet means, including a resiliently expandable and contractable split lock ring 102 disposed between the inner mandrel body 10 and the outer mandrel structure 15, and, more specifically, between the mandrel body 10 and the packing mandrel section 17. Co-engagable between the body lock ring 102 and the exterior of the mandrel body 10 are threads or ribs 103 on the mandrel body 10 and internal companion threads or ribs 104 within the split body lock ring 102. These threads or ribs are relatively fine and essentially provide roughened contact surfaces which enable the split body lock ring 102 to expand and move downwardly along the inner mandrel body 10. Return movement of the body lock ring 102 upwardly along the mandrel 10 is, however, prevented by companion external buttress type threads or ribs 105 on the split lock ring 102, and internal threads or ribs 106 on the interior of the packing mandrel 17, which provide transversely extended abutment surfaces preventing upward movement of the ring 102 with respect to the packing mandrel 17, and downwardly and inwardly inclined wedge surfaces which forceably urge the split lock ring 102 circumferentially inwardly into locking engagement between the ribs or threads 103 and 104 to prevent upward movement of the packing mandrel 17 with respect to the inner mandrel or body 10. Such body locking ring structure, per se, is well known, and an example of such a body lock is shown and specifically described in U.S. Pat. No. 3,311,171. The body locking means 101 allows the packing mandrel 17 to move downwardly with respect to the inner body mandrel 10 and the inner body mandrel 10 to move upwardly during setting of the packer P, and the lock ring 102 locks the pack-off force into the packing element 45 when the packer P is set.

In use, the packer assembly is made up on the tubing string and preferably connected to the upwardly extending tubing T by means of the on-off seal connector S shown in FIGS. 1*a* and 1*b*. This on-off seal connector S allows the tubing T to be released from the packer without requiring manipulation of the tubing string in a rotative direction.

In general, the seal connector S comprises a top sub 107 threadably connected at 108 to the tubing string T and having a threaded and sealed joint 109 with the top of an external tubular housing 110 which is connected at its lower end 110*a* to an internally threaded seal housing 111, which, in turn, is threadably connected to the top ring portion 112*a* of a collet 112. The seal housing 111 defines an annular space 111*a* between its internal surface and the polished external cylindrical surface 113*a* of a hollow seal mandrel 113 within which suitable slip seal elements 114 are mounted.

The seal mandrel 113 is connected at its lower end by threads 115 to the top end of a collet locking sub 116 which, in turn, has its lower end 117 secured by threads to the top end 11 of the inner mandrel body sleeve 10. The top end of the seal mandrel 113 is secured by threads 118 to the lower end of an annular seal nipple 119. The top end 119*a* of the seal nipple 119 terminates in spaced relationship below a downwardly facing shoulder 107*a* formed on the top sub 107. The internal contour of the seal nipple 119 is conventionally recessed as indicated at 120 to accomodate a wireline connecting tool (not shown), if required.

The collet locking sub 116 is further provided with a downwardly and inwardly inclined locking surface 116*a* with which the correspondingly shaped enlarged finger end portions 121 of the collet 112 are respectively engageable. The finger end portions 121 are, of course, resiliently radially shiftable to clear the shoulder 116*a* during the initial assembly of the on-off connector S. When, however, the collet locking sub 116 is secured to the inner mandrel body 10, the collet locking fingers 121 are held inwardly in their latched position by the top end 126 of a collet locking sleeve extension 125 which is secured by threads 127 to the top end of the hold-down head 21. Thus, the on-off connector S is securely attached to the packer P during the running of the packer P into the well.

Figure 2A:
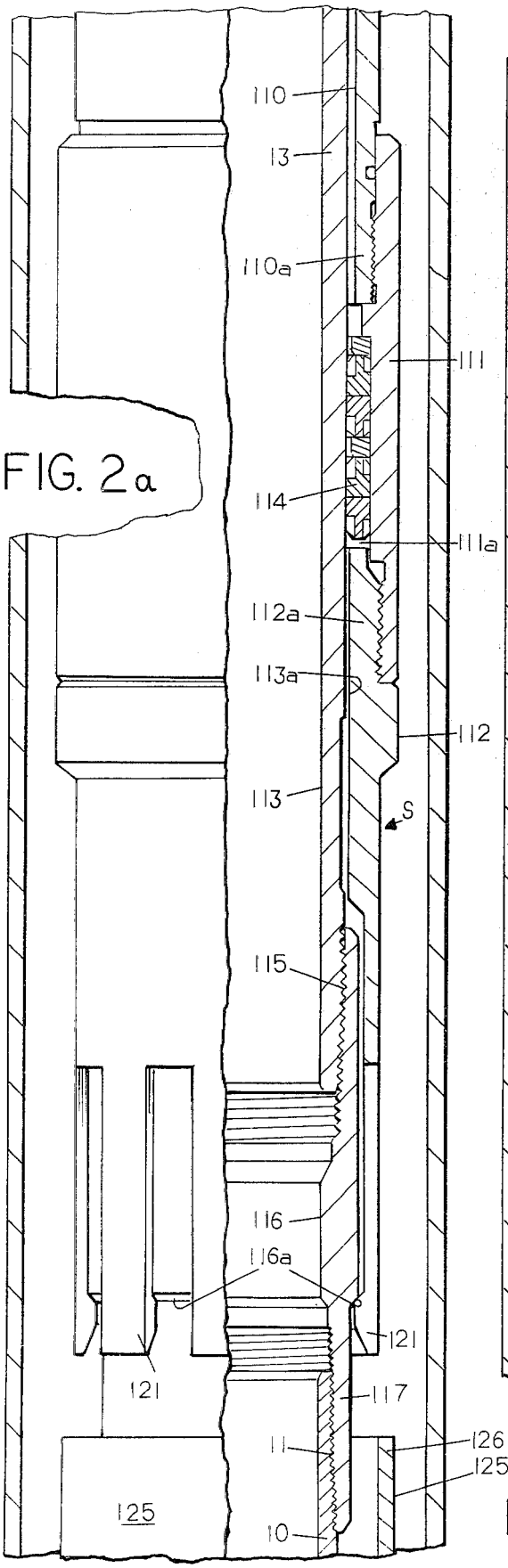
FIGS. 2*a*–2*c* together constitute a vertical elevational view, partly in section, corresponding respectively to FIGS. 1*b*, 1*c* and 1*d*, but with the components of the packer shown in their set position.
Figure 2B:
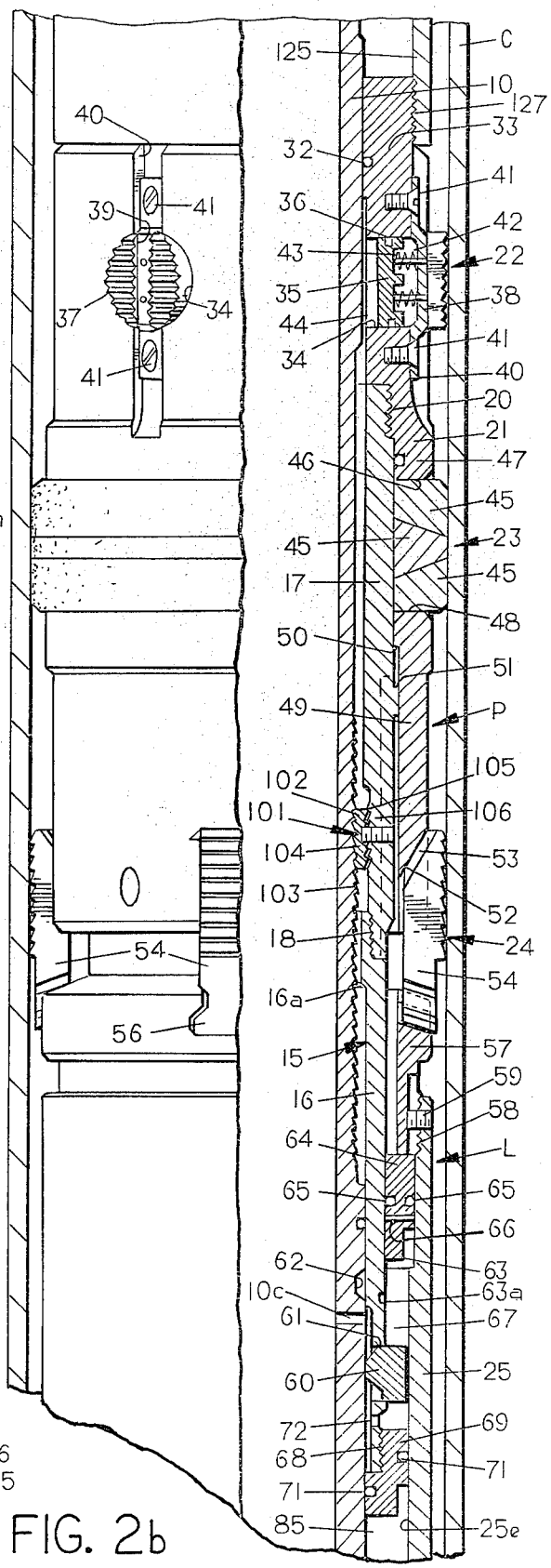

When, however, the packer P is set within the well through the application of tubing pressure, in the manner heretofore described, the head 21 moves downwardly and carries with it the collet locking sleeve 125, so that the top end 126 of such sleeve moves below the ends of the enlarged finger portions 121 of the collet locking sub 112, as shown in FIG. 2*a*. The on-off connector S may then be readily removed from the packer P by virtue of the enlarged collet finger end portions 121 sliding outwardly around the inclined surface 116*a* provided on the collet locking sub 116 as the tubing string T is lifted.

The external surface 113*a* of the seal mandrel 113 is of substantial axial extent and is polished so that in the event it is not desired to retrieve the tubing, the sliding sealed engagement between slip seal elements 114 and the polished cylindrical surface 113*a* of the seal mandrel 113 accommodates the thermal contraction and expansion of the tubing T. When it is desired to retrieve the tubing, the tubing T is merely pulled out of the well, and it carries with it the seal housing 111 and the locking collet 112.

A significant advantage of the described on-off connector S is the fact that no further wireline manipulations are required after the setting of the packer P. The connector S may be left in place to function as a slip seal if the tubing is not to be pulled or, if the tubing is pulled, the components of the on-off connector S will come out of the well with the tubing.

SETTING OF PACKER

The packer assembly P is lowered on the tubing string T to a desired setting location within the well casing. With the packer in the setting position, for example, as seen in FIGS. 1*a* through 1*d*, it is apparent that fluid can be displaced downwardly through the tubing string and through the bore of the inner body mandrel 10 of the packer P. When it is desired that the packer P be set, the pressure of fluid within the tubing T can be increased by inserting a conventional removable plug, check valve, or other means (not shown) either in the bottom sub 5 or in the tubing connected below the bottom sub 5.

The tubing pressure finds access to the pressure chamber 67 above the annular setting piston 69 through the port 10*c* in the inner mandrel body 10. Downward movement of the annular piston 69 is prevented by the latching segments 60 engaging in the annular groove 62 on the inner mandrel body 10 and being held therein by the latching piston skirt 63, until such time as the pressure within the chamber 67 acting upwardly on the latching piston 64 provides an upward force thereon in excess of the shear value of the shear screws 66, causing them to be sheared and permitting the piston 64 to move upwardly, thereby allowing the segments 60 to be automatically disengaged from the annular groove 62. Further upward movement of the piston 64 is limited by the bottom end of slip ring 57, which is axially fixed by the housing 25.

At this point, the mandrel structure 15 is caused to move downwardly with respect to the inner body or mandrel 10 under the influence of fluid pressure in the chamber 67 acting downwardly on the annular piston 69 and the pressure of fluid in the annulus acting on the mandrel portion 16. Relative upward movement of the inner body mandrel 10 with respect to the outer mandrel structure 15 produced by the tubing pressure is permitted by the body locking ring 102 as it ratchets downwardly over the ribs or threads 103 on the mandrel 10. The downward movement of the mandrel structure 15, which is coupled to the hold-down means 22, moves the packing engaging upper shoulder 46 downwardly towards the upwardly facing shoulder 48 provided by the expander member 49. The setting force is derived from the hydrostatic and applied tubing pressure acting on the differential area between the seal rings 65 and annulus pressure acting on the area of the mandrel 15 between the seal ring 65 and the opposed seal rings 71. This setting force is transmitted through the packing elements 45 to the expander member 49, thereby wedging the slips 54 outwardly relative to the fixed slip ring 57 to cause engagement of the teeth thereon with the well casing. Thereafter, the packing elements 45 are resiliently deformed axially and circumferentially outwardly into sealing and packed-off engagement within the casing C. An increase in the tubing pressure can then be applied to the conventional blanking or other pressure holding means (not shown), by which the tubing pressure was originally permitted to develop, to release such means and permit the tubing pressure to be reduced.

The packer P is thus firmly set and anchored in the casing C, and the force required to effect the pack-off is trapped or locked in the resilient packing elements 45 by virtue of the one-way lock between the body lock ring 102 and the packing mandrel 17 and the body 10, and the blocking of upward movement of mandrel 10 relative to housing 25 by shear ring 30.

Figure 2C:
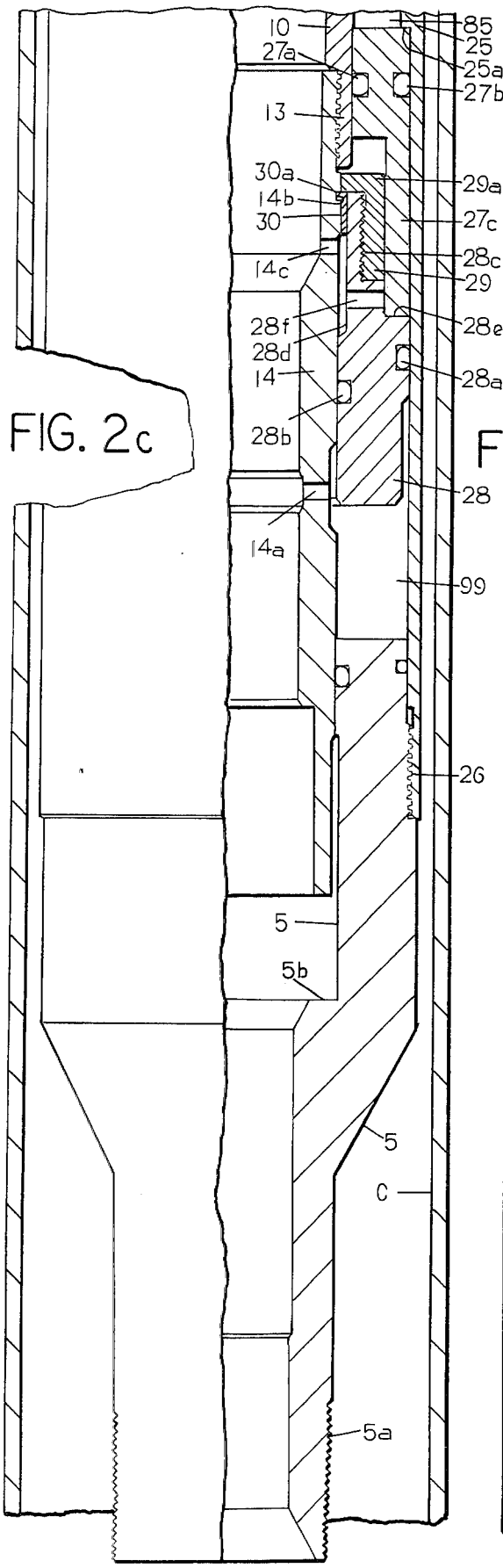

In the event that pressure below the set and anchored packer P exceeds the pressure in the annulus above the packer P, such pressure finds access between the packing mandrel 17 and the inner mandrel body 10 to the hold-down piston chambers 34 and can act upon the hold-down slips or anchors 35 to force them radially outwardly into engagement with the casing C, to prevent such differential pressure from moving the packer assembly upwardly within the well casing C. With the packer P in the set position, any downward force applied to the mandrel body 10 will be transmitted through the body lock ring 102 to the packing mandrel 15, causing the transmission of such force through the packing to the anchor slips. Any upward tension imposed on the tubing T will be transmitted through the mandrel body 10 and the shear ring 30 to the housing 25, and thus to the slips 54, following contact of the shear piston 28 with the lower end face 27*d* of the piston 27, which forms the atmospheric chamber 85, as seen in FIG. 2*c*.

RELEASING TOOL

Figure 3A:
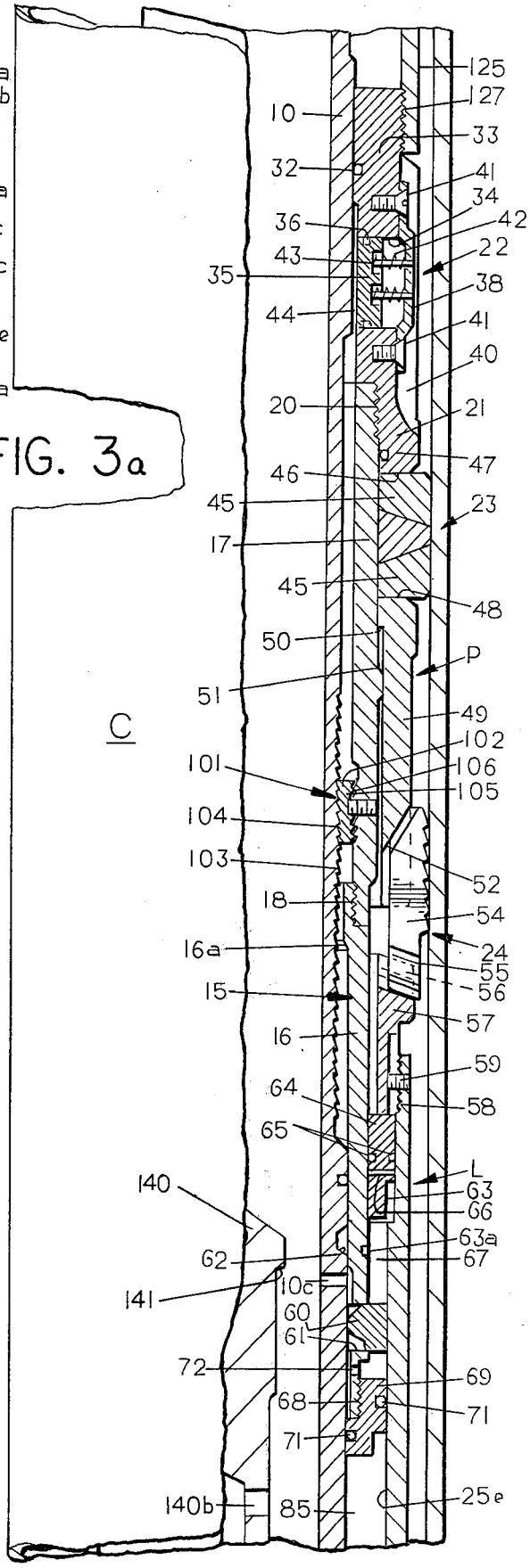
FIGS. 3*a*–3*b* together constitute a side elevational view, partly in section, of a packer embodying this invention having a fluid pressure actuated releasing tool inserted within the bore of the packer in its set condition, FIG. 3*b* being a continuation of FIG. 3*a*.
Figure 3B:
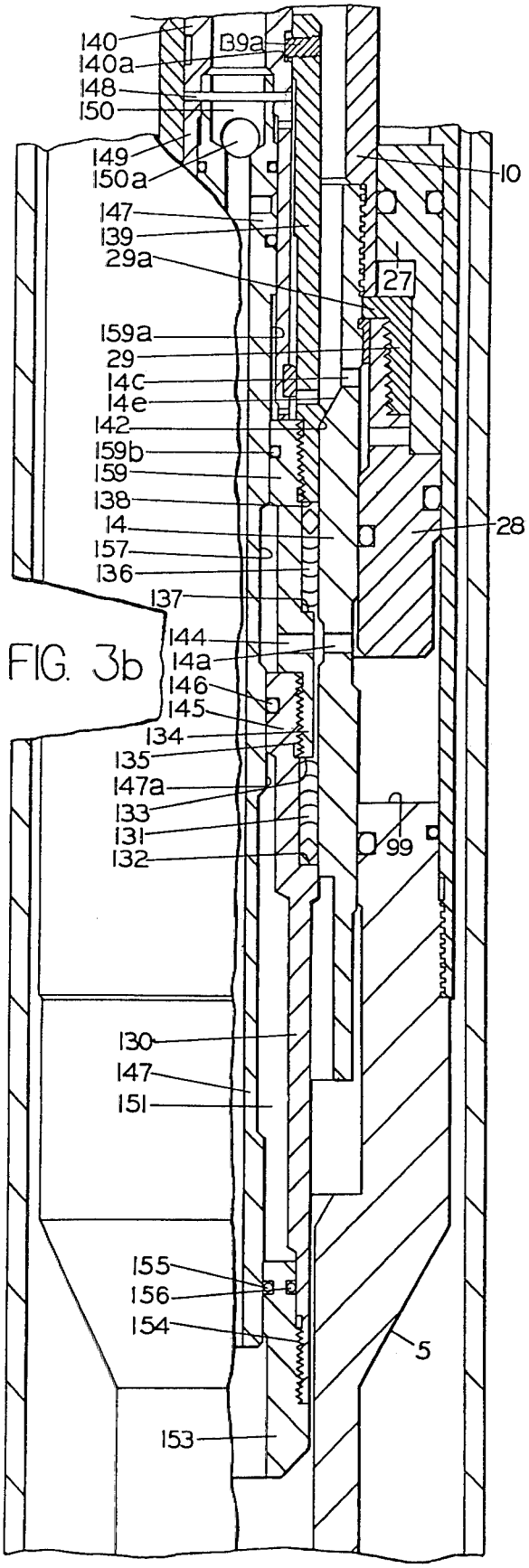

Fluid pressure actuated means are provided for releasing the packer P from its anchored set position in the well casing C. As seen in FIGS. 3*a* and 3*b* a releasing tool RT is adapted to be lowered through the pipe string or the tubing T on a wireline. The releasing tool RT comprises an outer body structure, including a lower sealing sleeve 130 having suitable packing means 131 carried thereby between an upwardly facing shoulder 132 on the sleeve 130 and the downwardly facing end 133 of an intermediate sealing sleeve 134. The intermediate sealing sleeve 134 is threadedly connected to the lower sealing sleeve by a suitable threaded connection 135 and carries an annular packing 136 between an upwardly facing shoulder 137 and the downwardly facing end 138 of an upper sealing sleeve 139. The upper sealing sleeve 139 is suitably connected by a plurality of bolts 139*a* to an annular groove 140*a* in a fishing neck 140 which provides a downwardly facing shoulder 141 adapted for engagement by the usual wireline running and retrieving tool to lower the releasing tool RT into engagement with the packer P.

Immediate the connection 138 between the two sealing sleeves, the tool RT has a downwardly facing shoulder 142 adapted to engage the upwardly facing landing shoulder 14*e* provided within the isolation sleeve 14 of the packer assembly, whereby the axially spaced packings 131 and 136 are caused to straddle the ports 14*a* in the isolation sleeve 14. Below the packing 136, the sealing sleeve 134 has a number of radial ports 144 which communicate with the ports 14*a* above an internal annular sealing flange 145 having an internal side ring seal 146 slidably and sealingly engaged with an internal cylindrical surface portion 147*a* of an elongated, inner tubular mandrel 147.

The mandrel 147 is connected to a lower sleeve extension 149 of a fishing neck 140 by a suitable shear pin 148, which traverses a check valve chamber 150 in the mandrel 147, which includes a ball valve 150*a*.

The lower portions of the mandrel 147 lie in inwardly spaced relationship with respect to the inner surface of the lower sealing sleeve 130 and thus define a chamber 151 which is maintained at atmospheric pressure existing during the assembly of the releasing tool RT. The lower end of the atmospheric chamber 151 is closed by an upwardly extended section 152 of a lower head 153 which is threaded into the lower sealing sleeve 130, as at 154, and has an inner side ring seal 155 and an outer side ring seal 156 sealingly engaged respectively with the outer cylindrical surface of the mandrel 147 and the lower cylindrical bore of the sealing sleeve 130. The internal surface of the mandrel 147 is recessed as indicated at 157 immediately above the sealing surface 147*a*.

With the releasing tool RT in place, the upper port 14*c* in the isolation sleeve 14 is open to the fluid within the tubing string through ports 140*b* in the fishing neck 140, and with the releasing tool mandrel 147 in the position of FIG. 3*b*, the port 14*a* is isolated by seals 131 and 136, and the releasing piston 28 remains pressure balanced. However, upon downward movement of the mandrel 147 from the position of FIG. 3*b* to the position of FIG. 4*a*, communication is established between the lower port 144 in the sealing sleeve 134, which communicates with the release piston chamber 99 below the release piston 28, and the atmospheric chamber 151.

Figure 4A:
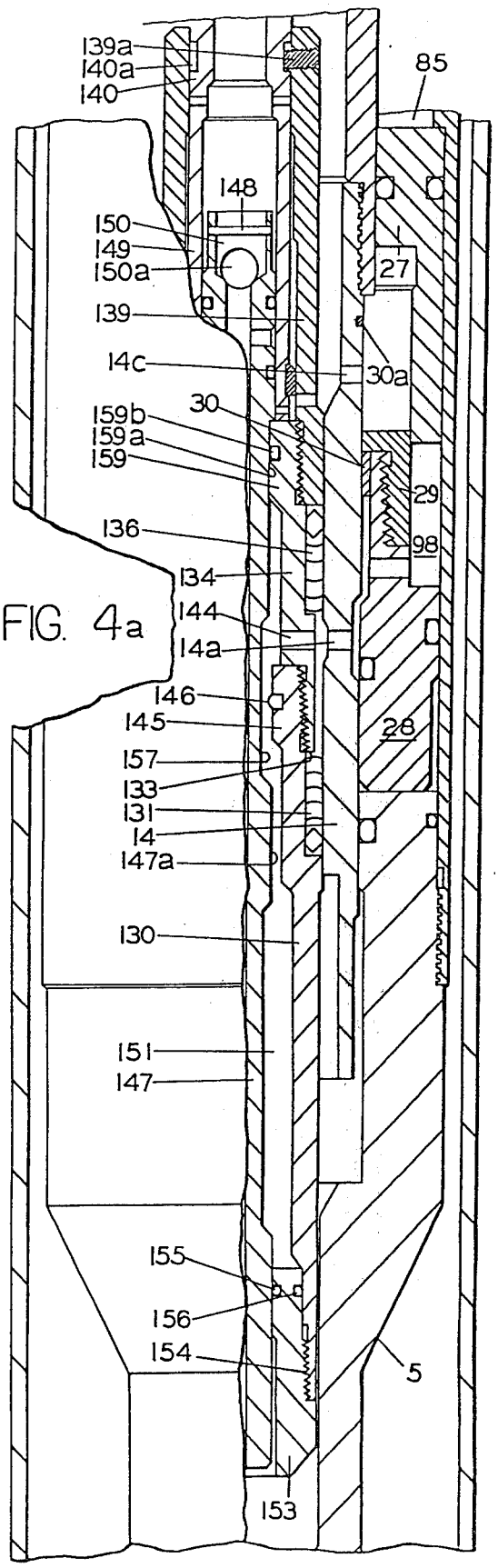
FIG. 4*a* is a view similar to FIG. 3*b*, illustrating the position of the elements of the assembly after operation of the fluid pressure actuated releasing tool to release the packer from its set condition.

Downward movement of the inner mandrel 147 is produced by increasing the tubing pressure to a level to effect the shearing of the shear pin 148 and permit the mandrel 147 to move to its lower position, shown in FIG. 4*a*. In this position, the pressure against the lower side of the release piston 28 is substantially reduced by the fluid connection established to the atmospheric chamber 151 contained in the releasing tool RT. Hence, the top side of the sealing piston 28 is subjected to an increasing downward force as tubing pressure increases until sufficient force is generated to effect the shearing of the locking ring portion 30*a* of the shear ring 30, thus permitting the piston 28 to move downwardly into abutment with the uppermost surface of the bottom sub 5, as shown in FIG. 4*a*.

Referring now to FIG. 4*a*, it will be seen that when the releasing tool mandrel 147 is moved downwardly by fluid pressure following shearing of the shear pin 148, a cylindrical sealing surface 159*a* on the mandrel 147, above the annular groove 157, moves into the sealing flange 159 and is engaged by the resilient side ring seal 159*b* in the flange. The lower cylindrical sealing surface 147*a* which was initially engaged within the sealing ring 146 of the sealing flange 145, is moved downwardly from sealing engagement with the seal ring 146, and the latter is bridged by the external groove or recess 157 in the mandrel 147. The groove 157 accordingly establishes communication between the atmospheric chamber 151, radial ports 144 and radial ports 14*a* which communicate with the release piston chamber 99. Thus, the pressure from the chamber 99 is bled off into the atmospheric chamber 151, while the hydrostatic pressure of fluid in the tubing above the packer assembly is applied to the upper end of the release piston 28 in the chamber 98 via the radial ports 14*c* in the isolation sleeve 14. If the hydrostatic pressure of fluid within the tubing string is insufficient to cause downward movement of the shear piston 28 with resultant shearing of the shear ring 30, additional fluid pressure can be applied to the tubing to cause such downward movement of the piston 28 and shearing of the shear ring 30, as illustrated in FIG. 4*a*.

After the shear ring 30 has been sheared, the tubing T can be elevated, so that, as can be seen from FIG. 4*a*, the chamber 98 communicates with the tubing through the port 14*c*, and the setting force is relieved. An external, upwardly facing shoulder 10*a*, shown in FIG. 1*c*, on the inner mandrel or body 10 engages beneath an internal downwardly facing shoulder 16*a* within the outer mandrel structure 15, and, more particularly, at the connection between the connector mandrel 16 and the packing mandrel 17. The body lock ring 102 permits the body 10 to ratchet upwardly through the lock ring, and upon co-engagement of the opposing shoulders 10*a* and 16*a*, the reduced diameter section 10*b* of the body 10 is disposed within the holddown head 21, so that hydrostatic pressure is equalized across the holddown pistons or buttons 35, and the latter are returned to their normally retracted positions by the return springs 42. The outer mandrel structure 15 then moves upwardly with the inner body 10, effecting retraction of the anchor slips 54 and allowing the resilient packing elements 45 to resume their normal condition, so that the packing assembly can be retrieved from the well casing C.

In the event that tubing pressure cannot be developed within the tubing, or the release of the packer P cannot be accomplished by the increase in tubing pressure, the packer P may nevertheless be mechanically released. A conventional connecting tool, (not shown) is lowered through the tubing string to effect engagement with the recess 120 of the seal nipple 119 which, is rigidly connected to the inner mandrel body 10. Exertion of an upward force by the wireline on the inner mandrel body 10 will then have the effect of moving the releasing piston 28 into abutting engagement with the lower end of the isolation piston 27, thus effecting the shearing of the shear ring 30, and permitting the inner mandrel body 10 to move upwardly relative to the outer mandrel structure 15 until the external shoulder 10*a* on the inner mandrel body 10 engages the downwardly facing shoulder 16*a* on the intermediate mandrel 16, whereupon the mandrel structure 15 is elevated to release the setting forces on the packing 23 and the slip 24. Following such release, the entire packer assembly can be readily removed from the well casing.

From the foregoing, it will be seen that the present invention provides a pressure set and locked casing packer with release means also entirely actuated by fluid pressure, whereby the packer can be advantageously employed in a variety of applications where manipulation of the tubing is not possible or practical.

If for any reason the packer fails to release upon the increase in tubing pressure, or if sufficient tubing pressure can not be generated, the packer can nevertheless be released and retrieved mechanically by lowering a connecting tool on a work string to engage a nipple element connected to the inner body mandrel, following which the packer may be released by upward force exerted on the inner body mandrel by the work string.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a well conduit packer of the type having an elongated tubular body connectible in a running tubing string, said tubular body comprising co-axially disposed and relatively movable inner and outer mandrels, normally retracted slip means on said tubular body operable by relative movement of said mandrels to expand said slip means into engagement with the conduit, resilient packing means on the body deformable into sealing engagement with the conduit by said relative movement of said mandrels and means responsive to the pressure of fluid in the bore of said body for producing relative axial movement of said mandrels, the improvement comprising: a member surrounding the lower portions of said outer mandrel and extending axially below the end of said inner mandrel, and means mounted on said member for closing fluid passage through the packer, whereby tubing pressure may then be raised, said inner mandrel being axially shiftable upwardly under the influence of said tubing pressure to facilitate the action of said pressure responsive means.

2. The improvement of claim 1 further comprising a slip camming sleeve surrounding said outer mandrel, and means for securing said member to said slip camming sleeve, thereby fixing the axial position of the slip camming sleeve.

3. The improvement of claim 1 or 2 further comprising an isolation sleeve secured to the bottom end of said inner mandrel and slidably engaging the interior wall of said member.

4. A well conduit packer comprising: an elongated tubular body connectible in a running tubing string, said tubular body comprising: co-axially disposed and relatively axially movable inner and outer mandrels; radially shiftable slip means on said body expandable into engagement with the conduit; resilient packing means on said body deformable outwardly into sealing engagement with the conduit; setting means mounted on said outer mandrel for expanding said slip means and deforming said packing means, said setting means including: a camming sleeve surrounding said outer mandrel but axially movable relative thereto, a member surrounding the lower portions of said outer mandrel and extending axially below the end of said inner mandrel; sleeve means for connecting said member to said camming sleeve, thereby axially positioning said camming sleeve, means mounted on said member for closing fluid passage through the packer, whereby tubing pressure within the tubing string and packer may then be raised; means responsive to increased tubing pressure for axially shifting said outer mandrel relative to said inner mandrel; locking means for holding said outer and inner mandrels in their pressure shifted position, and means responsive to the relative movement of said outer and inner mandrels with respect to said camming sleeve for operating said setting means.

5. The packer of claim 4 further comprising latch means releasably responsive to fluid pressure in said tubing to prevent relative movement of said mandrels until the fluid pressure reaches a pre-determined level.

6. A fluid pressure operated well conduit packer, comprising: an elongated, tubular inner mandrel body; an outer mandrel structure longitudinally shiftable on said inner mandrel body; locking means permitting relative longitudinal shifting of said outer mandrel structure in one direction with respect to said inner mandrel body and preventing relative longitudinal shifting in the other direction; resiliently deformable packing means on said outer mandrel structure; normally retracted, expandable anchor slip means on said outer mandrel structure; a camming sleeve engageable with said slip means upon the occurrence of said relative longitudinal shifting of the outer mandrel structure with respect to the inner mandrel body in said one direction; an elongated sleeve connected at its top end to said camming sleeve and at its lower end to a member which extends beyond the lower ends of both said inner mandrel body and said outer mandrel structure, said sleeve being radially spaced from said inner mandrel body and defining an annular pressure chamber therebetween; latching means for securing said outer mandrel structure to said inner mandrel body; an unlatching piston disposed in said annular chamber and operable by an increase in tubing pressure to release said latching means; means for closing the fluid passage through said member, thereby permitting fluid pressure within the bore of said inner mandrel body to be increased to a pre-determined level effective to release said latching means; and fluid passage means from said bore to said annular chamber.

7. The packer of claim 6 wherein an isolation sleeve is secured to the bottom end of said inner mandrel body and slidably engages the interior bore of said member.

8. The packer of claim 6 wherein said annular fluid chamber also includes a packing release piston disposed between two additional axially spaced fluid passage means leading from said bore into said chamber; release means insertable in said inner mandrel body and having a low pressure chamber and a member shiftable from one position at which each said passage means is in communication between said bore of said inner mandrel body and said release piston chamber to another position at which only one of said passage means communicates with said low pressure chamber, thereby producing an axial shifting of said release piston; and releasable means on said inner mandrel body engageable by said piston to release said inner mandrel body for upward movement to release said packing means and said slip means.

9. The packer of claim 8 wherein said releasable means constitutes a shearable member engaged by said release piston.

10. The packer of claim 8 wherein said release means includes means removably supporting same in said inner mandrel body, and means connectable to a running tool to removably dispose said release means in said body.

11. The packer of claim 8 wherein an isolation sleeve is secured to the bottom end of said inner mandrel body and slidably engages the interior of said member, and said two additional fluid passage means are formed in said isolation sleeve.

12. The packer of claim 1, 6 or 8 wherein the upper end of said inner mandrel body is provided with wireline connectable means, whereby the application of an upward force by wireline to said inner mandrel body will effect the mechanical release of the packer.

* * * * *